US005349974A

United States Patent [19]

Mansur

[11] Patent Number: 5,349,974

[45] Date of Patent: Sep. 27, 1994

[54] GENERAL PARTS WASHER

[75] Inventor: Pierre G. Mansur, Miami, Fla.

[73] Assignee: Mansur Industries Inc., Miami, Fla.

[21] Appl. No.: 207,136

[22] Filed: Mar. 4, 1994

[51] Int. Cl.[5] ..... B08B 3/02

[52] U.S. Cl. ..... 134/107; 134/108; 134/111

[58] Field of Search ..... 134/105, 107, 108, 109, 134/111; 202/170

[56] References Cited

U.S. PATENT DOCUMENTS

| | | | |
|---|---|---|---|
| 2,834,359 | 5/1958 | Kearney | 134/108 X |
| 3,598,131 | 8/1971 | Weihe, Jr. | 134/107 |
| 3,718,147 | 2/1973 | Laroche | 134/108 X |
| 3,996,949 | 12/1076 | Boynton | 134/108 X |
| 4,008,729 | 2/1977 | Chizinsky | 134/107 |
| 4,290,439 | 9/1981 | Charpentier | 134/107 |
| 4,353,323 | 10/1982 | Koblenzer | 134/107 X |
| 4,596,634 | 6/1986 | McCord | 134/107 X |
| 4,865,061 | 9/1989 | Fowler et al. | 134/108 |

FOREIGN PATENT DOCUMENTS

| | | | |
|---|---|---|---|
| 662742 | 3/1929 | France | 134/105 |
| 2394334 | 2/1979 | France | 134/109 |

*Primary Examiner*—Philip R. Coe
*Attorney, Agent, or Firm*—Robert M. Downey

[57] ABSTRACT

An apparatus for washing automotive, aviation, marine and general parts with a volatile solvent during maintenance, repair and rebuilding operations. The apparatus includes a wash basin with a drain to facilitate return of the solvent to a holding tank having a pump therein for recirculating the solvent back to the wash basin through a discharge spout for washing parts. A first valve assembly between the drain and holding tank closes during periods of non-use to prevent vapors from escaping to the atmosphere. During a timed recycling process, a second valve assembly releases used, contaminated solvent from the holding tank into a distillation pot where the solvent is heated under vacuum to produce vapors. The vapors pass through a condenser where they are cooled to a liquid state, yielding pure solvent, which is directed into the holding tank for future parts washing as demanded.

11 Claims, 6 Drawing Sheets

FIG. 1
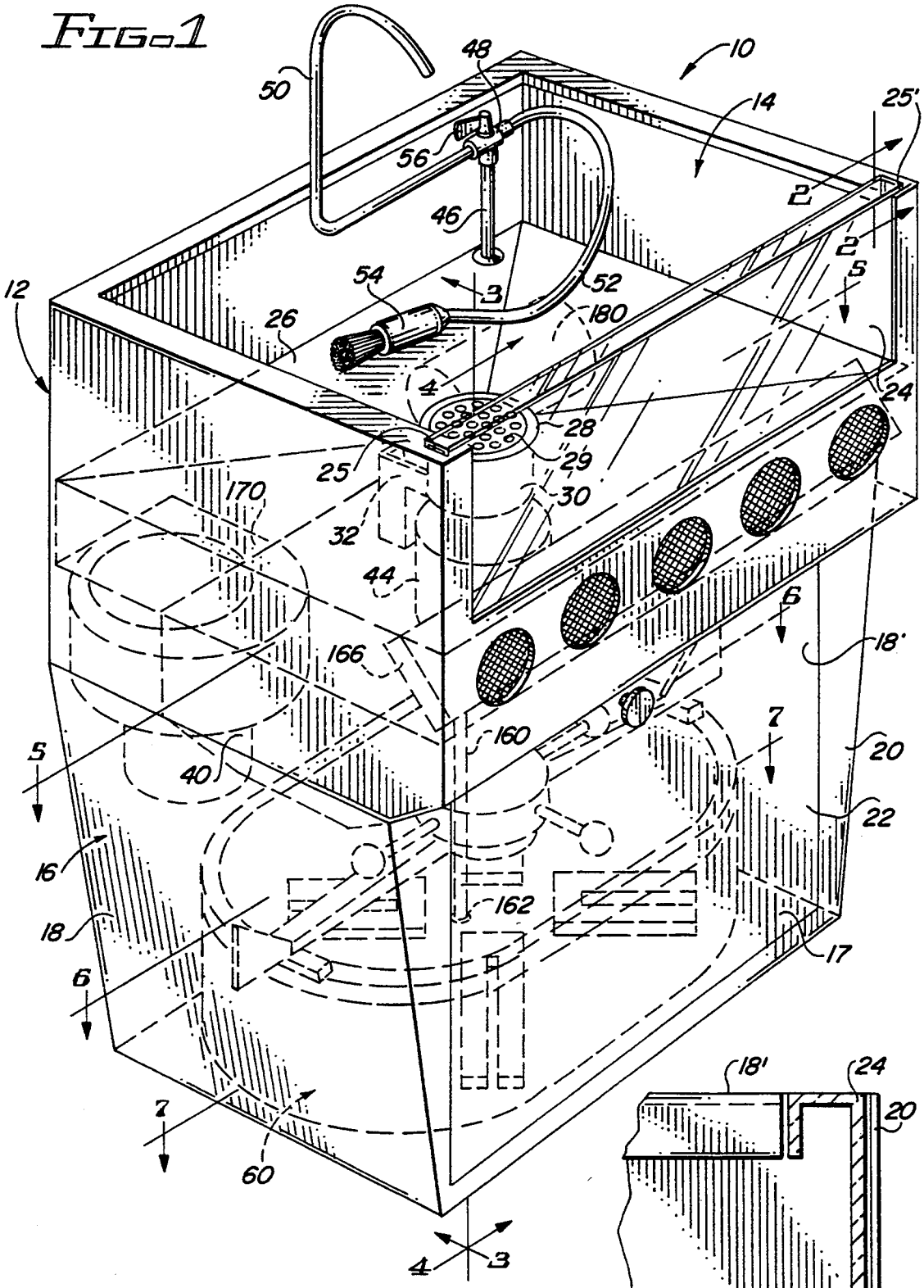
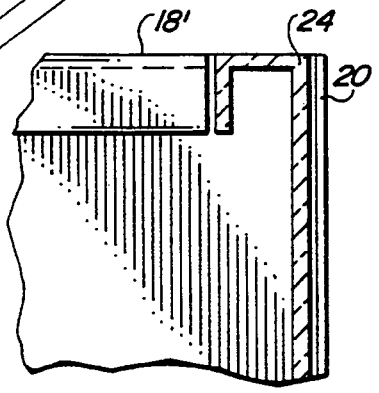
FIG. 2

FIG. 5
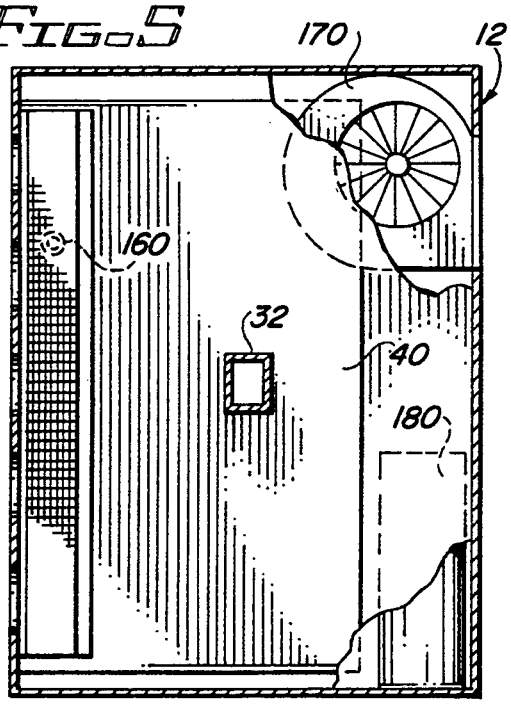
FIG. 6
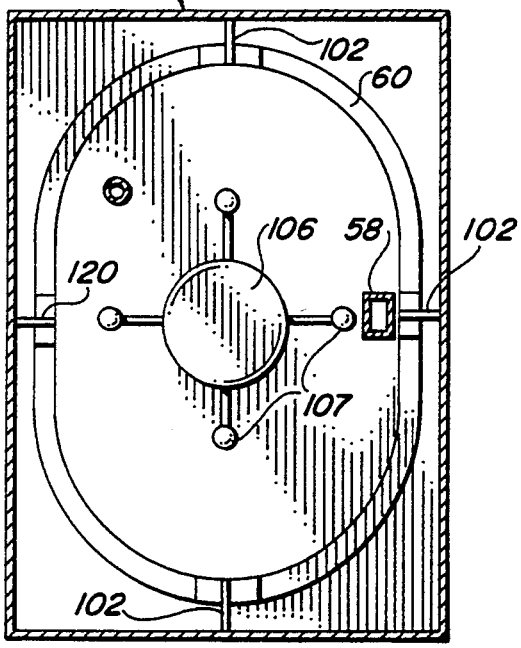
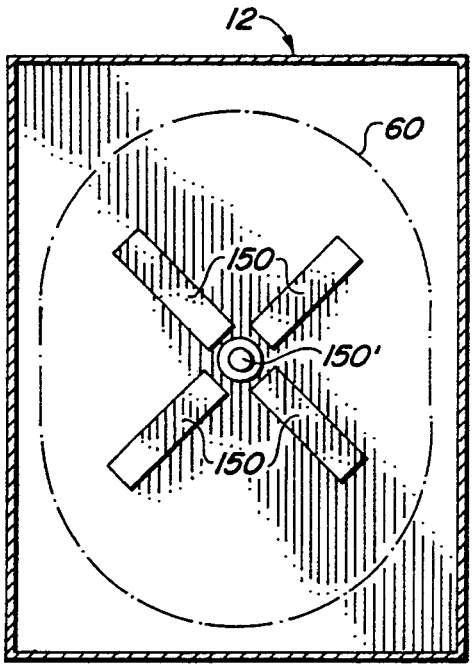
FIG. 7
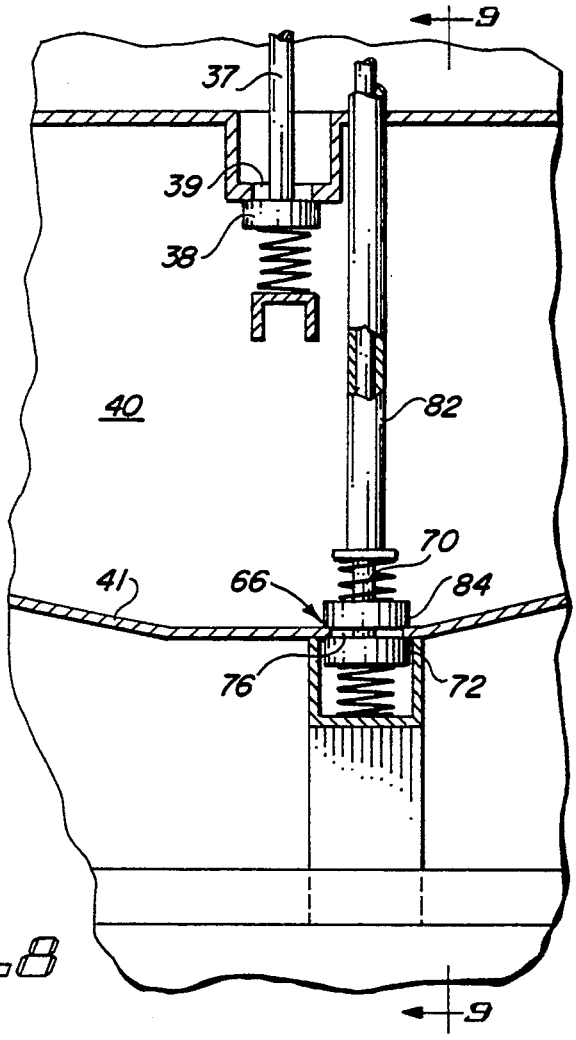
FIG. 8

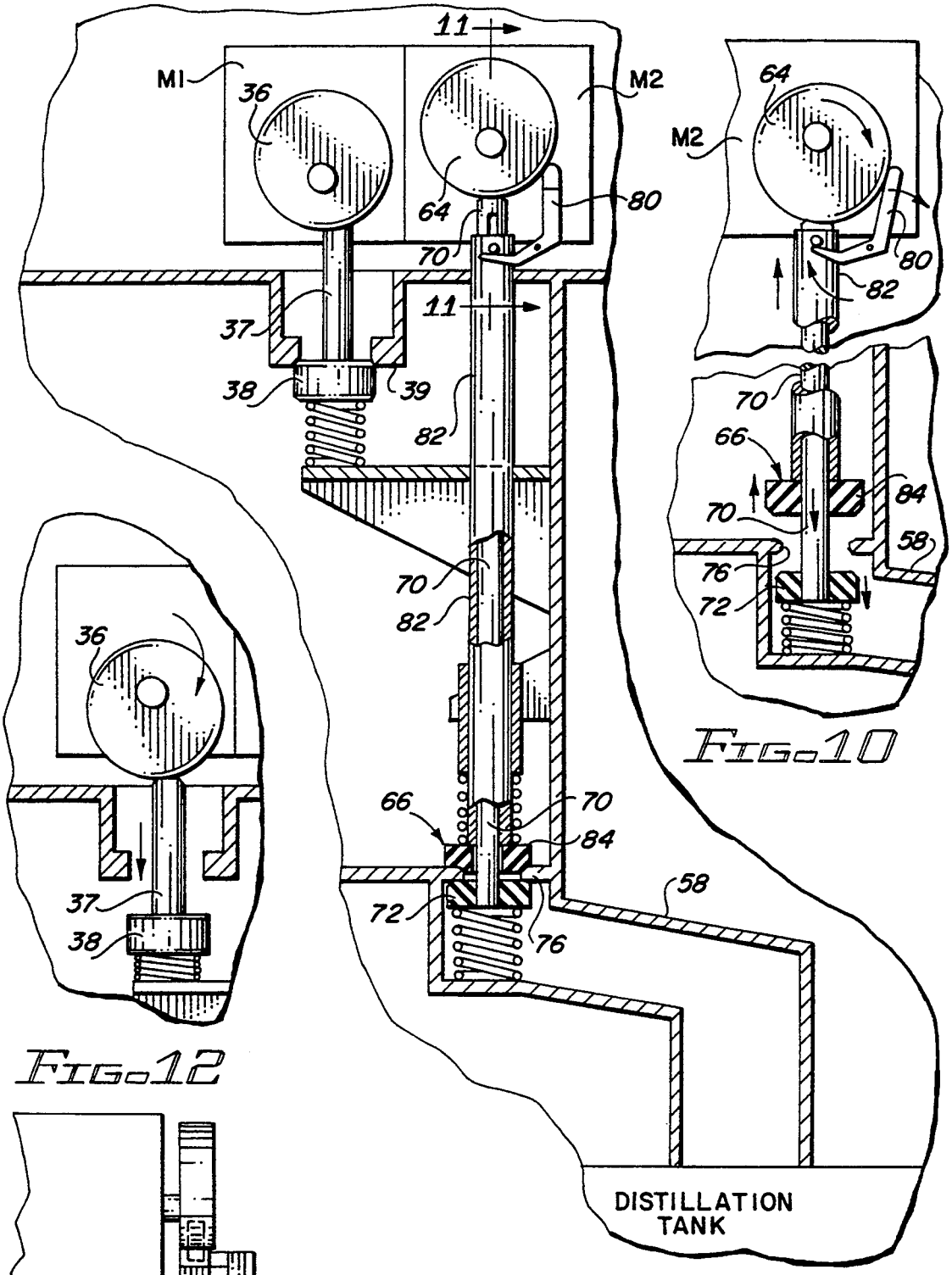
FIG. 10
FIG. 12
FIG. 9
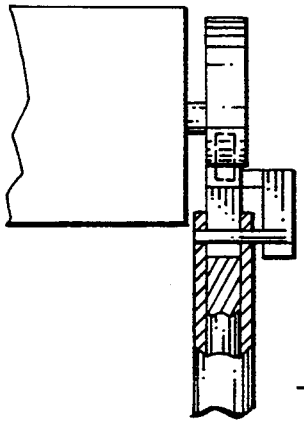
FIG. 11

GENERAL PARTS WASHER

BACKGROUND OF THE INVENTION

1. Field of the Invention

This invention relates to an apparatus for washing articles with a liquid solvent, and more particularly, to a general parts washer providing for recycling of contaminated, dirty solvent during a timed recycling process to produce pure, non-contaminated solvent on a regular basis for use in washing parts during maintenance, repair, and rebuilding operations.

2. Description of the Related Art

During maintenance, repair and rebuilding operations in virtually all industrial and commercial environments, it is necessary to wash a wide variety of parts and articles in order to remove grease, oil, dirt and other contaminants. Typically, volatile solvents are used in almost all small parts cleaning operations as they have been found to be most effective in removing grease and other accumulated residue from metal parts and other articles.

In order to facilitate washing of various parts with a volatile solvent, such as a hydrocarbon or halogenated hydrocarbon, there is presently available a sink which is removably supported on top of a 55 gallon drum filled with cleaning solvent. A pump is provided which pumps the solvent from the drum to a spicket in the sink where it is used to rinse parts. From the sink, the solvent is drained back into the drum. During washing operations, the solvent becomes immediately contaminated after the first use. However, the contaminated solvent is continuously used during cleaning operations until a next scheduled solvent replacement, which is usually on a monthly basis. The regular replacement of contaminated solvent is ordinarily provided by a service, which also supplies the washing apparatus, on a service contract basis. To replace the solvent, the sink is removed from the drum containing the contaminated solvent and is placed on another drum containing fresh solvent. The contaminated drum of solvent must then be taken away and disposed of in a manner complying with EPA contaminant disposal guidelines. This procedure is inefficient, costly and time consuming, leaving a busy manufacturing or repair facility with no other alternative than to perform parts cleaning operations using dirty, contaminated solvent between scheduled solvent replacement dates.

Various types of systems and apparatus have been proposed and/or developed for cleaning metal parts and like articles using volatile solvents. In many applications, the solvent is heated to produce vapors. The various articles to be cleaned are either bathed in the vapors or in a condensed stream of volatile solvent. Some of these various apparatus systems are disclosed in the following U.S. Pat. Nos.: Chizinsky, U.S. Pat. No. 4,008,729; Laroche, U.S. Pat. No. 3,718,147; McCord, U.S. Pat. No. 4,596,634; Boynton, U.S. Pat. No. 3,996,949; and Koblenzer, U.S. Pat. No. 4,353,323. Generally, all of the cleaning apparatus disclosed in these patents include a base reservoir where the solvent is contained and heated to produce vapors. As the vapors rise, they are condensed to a liquid solvent which drips back down into the base reservoir. Articles placed within the various apparatus are cleaned by either the rising vapor or the condensed solvent. In any event, the solvent in the reservoir accumulates contaminates in a short period of time and, eventually, the contaminated solvent must be removed, properly disposed of and replaced with clean solvent. Therefore, there still exists the problem associated with the time and expense of contaminate disposal.

Accordingly, there is a definite need in all industries requiring parts cleaning during maintenance, manufacturing, repair and rebuilding operations, for a parts washing apparatus including a sink or basin for washing parts with a volatile solvent and means for recycling the solvent to provide pure, non-contaminated solvent on a daily basis.

SUMMARY OF THE INVENTION

The present invention is directed to an apparatus for washing (cleaning) articles such as general machine and engine parts, which provides pure, fresh solvent on demand.

More particularly, the present invention includes a timed recycling process which recycles contaminated, dirty solvent on a regular basis to provide pure solvent for cleaning, thus eliminating the need for regular replacement and disposal of contaminated solvent. Accordingly, the present invention provides a practical and economical means of complying with contaminate disposal guide lines of the Environmental Protection Agency.

In accordance with the general parts washing apparatus of the present invention, there is provided a cabinet having an upper wash basin including an at least partially surrounding wall structure defining a splash guard, an open top and a removable front wall portion. The wash basin further includes a floor which slopes slightly downward from the sides, front and rear towards a centrally disposed drain to facilitate recovery of solvent after use. A lower portion of the cabinet is defined by side wall panels and a base disposed in surrounding relation to a cabinet interior. Once the solvent has passed through the drain and a filter, the solvent returns to a holding tank within the cabinet interior below the wash basin. A pump recirculates the solvent from the holding tank to a spout which discharges the solvent into the wash basin for rinsing articles during what might be termed a wash cycle.

During a timed recycling process, containment valves are opened, releasing the solvent from within the holding tank to a distillation pot. After a timed delay, the valves are closed and a vacuum pump is activated, creating a vacuum in the distillation pot and holding tank while the solvent is heated to a boiling point. The vacuum in the distillation pot is maintained, effectively lowering the solvent boiling point temperature, as vapors rise from the distillation pot through a condenser tube. The condenser tube passes through a cooling zone created by a blower where the vapors condense to a liquid state, producing pure recycled solvent. This fresh solvent is then led into the holding tank for subsequent use during the wash cycle.

A lid covers the distillation pot, in sealed relation thereto, during the recycling process. To facilitate cleaning, the distillation pot can be lowered, removing the lid, and pulled out from the lower cabinet, whereupon accumulated contaminate can be more efficiently and effectively removed from within the pot.

Accordingly, with the foregoing in mind it is a primary object of the present invention to provide a general parts washing apparatus for use in cleaning parts during maintenance, repair and rebuilding operations, which includes means for recovering and recycling cleaning solvent so as to provide a user with "on-demand" pure solvent on a daily basis for cleaning.

It is another object of the present invention to provide a general parts washing apparatus, as described above, which eliminates the need for constant replacement and disposal of contaminated cleaning solvent, while providing a practical and economical means of complying with environmental protection agency contaminant disposal guidelines.

It is a further object of the present invention to provide a general parts washing apparatus adapted to recycle volatile solvent so as to provide fresh, pure solvent on a regular basis and which is further relatively compact and inexpensive.

It is still a further object of the present invention to provide a general parts washing apparatus, as described above, which operates on common 120 volts and which further requires no special water or air requirements.

It is yet another object of the present invention to provide a general parts washing apparatus, as described above, which complies with all government imposed safety requirements.

It is still another object of the present invention to provide a general parts washing apparatus as described above, which is further engineered and designed to permit a user to siphon residual contaminates from the distillation pot bottom without manually accessing the pot.

These and other objects and advantages of the present invention will be more readily apparent in the description which follows.

BRIEF DESCRIPTION OF THE DRAWINGS

For a fuller understanding of the nature of the present invention, reference should be had to the following detailed description taken in connection with the accompanying drawings in which:

FIG. 1 is a front, top perspective view of the general parts washing apparatus of the present invention.

FIG. 2 is an isolated view, in partial section, taken along the plane of line 2—2 of FIG. 1.

FIG. 5 is a top plan view, in partial section, taken along the plane of line 5—5 of FIG. 3.

FIG. 6 is a top plan view, in partial section, taken along the plane of line 6—6 of FIG. 3 illustrating a top of the distillation pot.

FIG. 7 is a top plan view, in partial section taken along the plane of line 7—7 of FIG. 3 showing heating elements in the distillation pot.

FIG. 8 is a isolated elevational view in partial section, illustrating a vapor containment valve assembly and solvent containment valve assembly of the present invention.

FIG. 9 is an isolated detailed elevational view, in partial section taken along the plane of line 9—9 of FIG. 8 illustrating, in detail, the vapor containment valve assembly and solvent containment valve assembly.

FIG. 10 is an isolated view, in partial section, showing the solvent containment valve assembly in an open position.

FIG. 11 is an isolated front elevation of an upper portion of the solvent containment valve assembly showing a motor, cam member, inner valve stem and outer valve stem thereof.

FIG. 12 is an isolated side elevation, in partial section, showing the vapor containment valve assembly in an open position.

Like reference numerals refer to like parts throughout the several views of the drawings.

DETAILED DESCRIPTION OF THE PREFERRED EMBODIMENT

Figure 4:
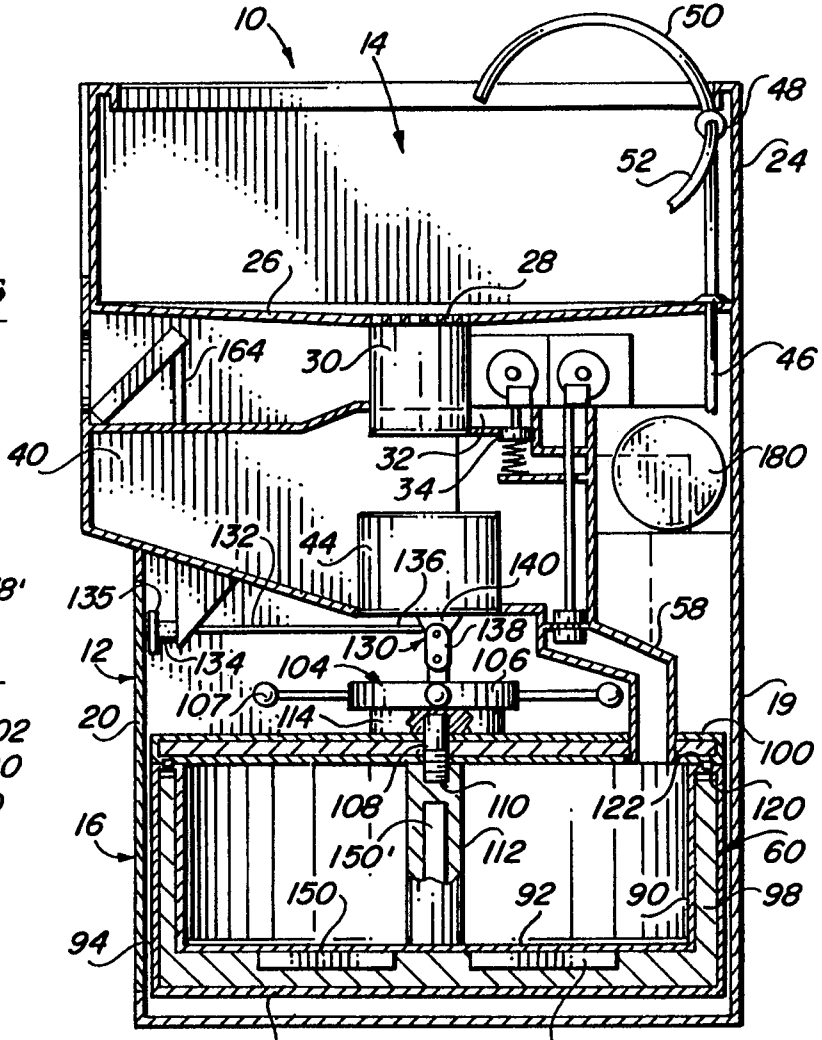
FIG. 4 is a side elevation, in partial section, taken along the line 4—4 of FIG. 1.
Figure 3:
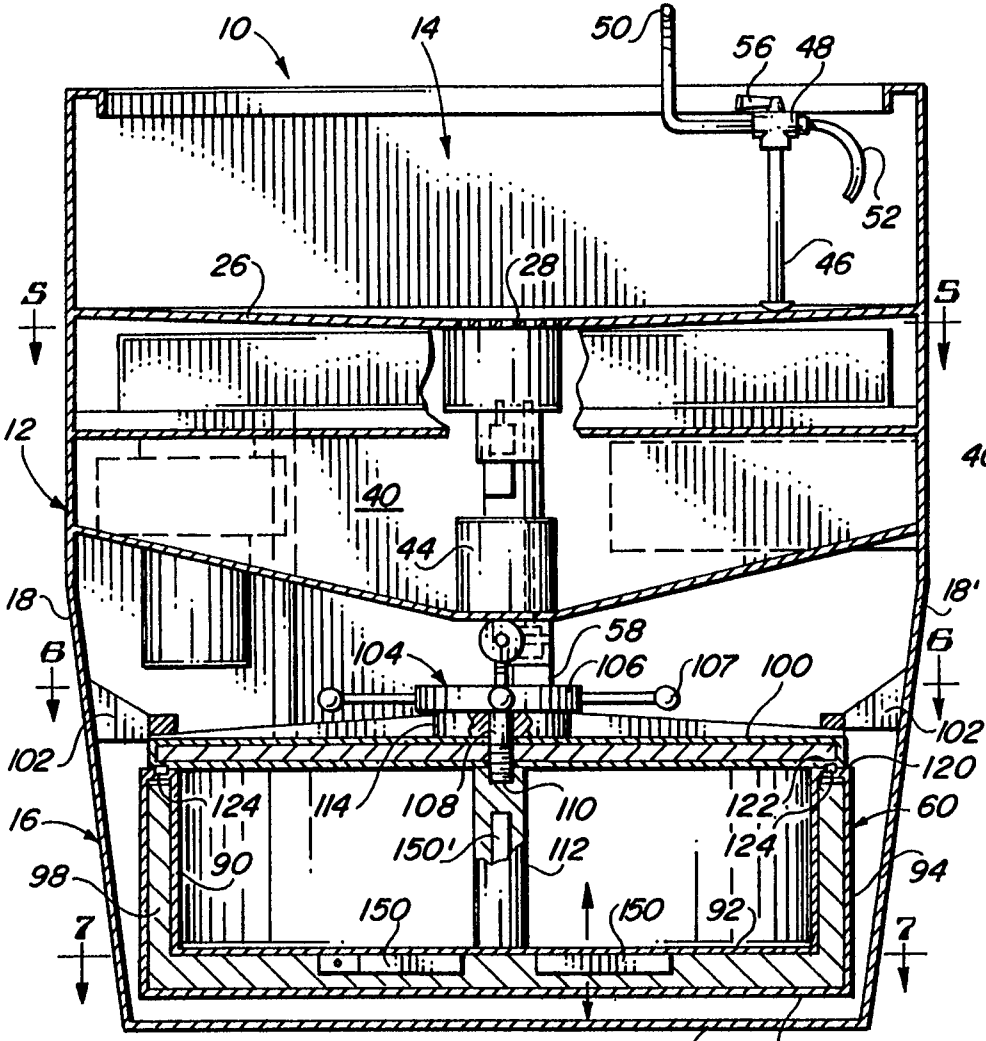
FIG. 3 is a front elevation, in partial section, taken along the plane of line 3—3 of FIG. 1.

Referring to the several views of the drawings, and initially FIGS. 1, 3 and 4, there is generally illustrated the general parts washing apparatus 10 of the present invention. The apparatus 10 includes a cabinet 12 including an upper portion defining a wash basin 14 and a lower portion 16 including a base 17, side walls 18, 18' rear wall 19 and a front wall 20. The front wall 20 is at least partially comprised of a door 22 which is hinged to move between an open and closed position facilitating access to a cabinet interior. The side walls 18, 18' and rear wall 19 extend upwardly beyond a floor 26 of the wash basin 14 so as to partially surround the wash basin, defining a splash guard. A wall panel 24 is removably fitted within opposite channels 25, 25' formed between an upper portion of the front wall 20 and opposite side walls 18, 18'. During washing operations, the front wall panel 24 can be pulled upwardly and removed from a remainder of the apparatus 10. In this manner, access to the wash basin 14 is unobstructed from a front of the apparatus 10.

The floor 26 in the wash basin 14 is sloped from the sides, rear and front, downwardly towards a central zone where there is located a drain 28, including a drain plate 29 through which solvent drains after use for washing articles in the basin 14. After passage through the drain plate 29, the solvent is directed through a filter 30 fitted directly below the drain plate. From the filter, the solvent is led through a return canal 32 which leads to a solvent holding tank 40. A vapor containment valve 34 is provided at the connection of the return canal 32 to the solvent holding tank 40. During periods of non-use, the vapor containment valve 34 is closed, thus preventing solvent vapors from escaping to atmosphere from within the holding tank. The holding tank 40 is sized and configured to contain a predetermined amount of solvent therein for continuous recycling and reuse during cleaning operations.

Figure 13:
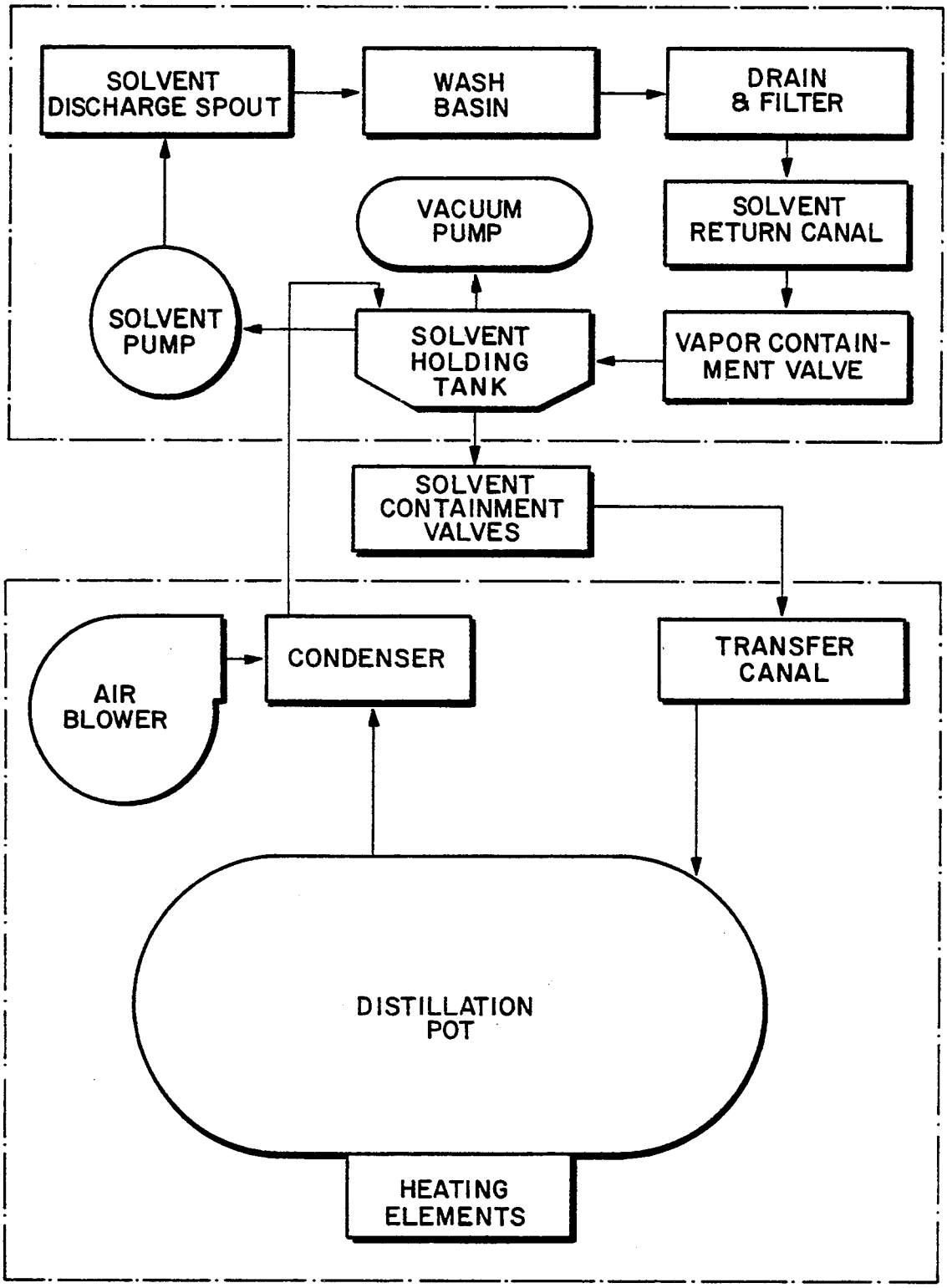
FIG. 13 is a schematic diagram illustrating a sequence of operation of components of the washing apparatus during a wash cycle and a solvent recycling distillation cycle.

A pump 44 within the holding tank 40, located at a bottom thereof, recirculates the solvent in the holding tank through a return conduit 46 leading to a three way valve 48 interconnecting between the return conduit and a spout 50 and a hose 52 having a wash brush 54 attached to an end thereof. A valve lever 56 facilitates operation of the valve to direct flow of solvent to either or both the spout 50 and hose 52 for subsequent discharge into the wash basin 14. The brush 54 attached to the hose 52 is specifically designed to permit fluid flow therethrough so that articles may be brushed and simultaneously rinsed with solvent to remove accumulated grease, dirt and other contaminants from the articles being washed. Once discharged from either the spout 50 or brush 54 for rinsing the various articles being cleaned, the solvent returns to the holding tank through the drain 26 and return canal 32. An electric switch is provided and is easily accessible on an exterior of the apparatus 10 (not shown for purposes of clarity) to facilitate de-activation of the pump 40 during periods of nonuse. To this point, a wash cycle (see FIG. 13, 15A & 15B) has been defined which continues during parts washing operations.

Figure 14:
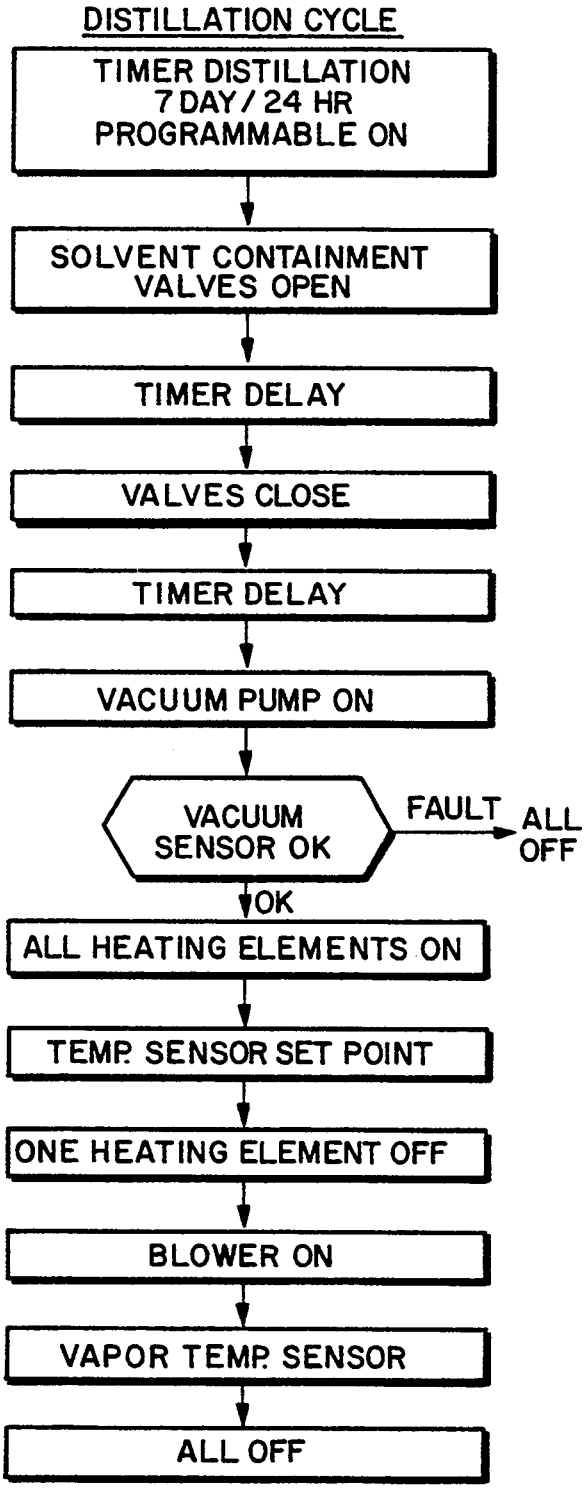
FIG. 14 is a flow diagram illustrating a sequence of operation throughout the solvent recycling distillation cycle.
Figure 15A:
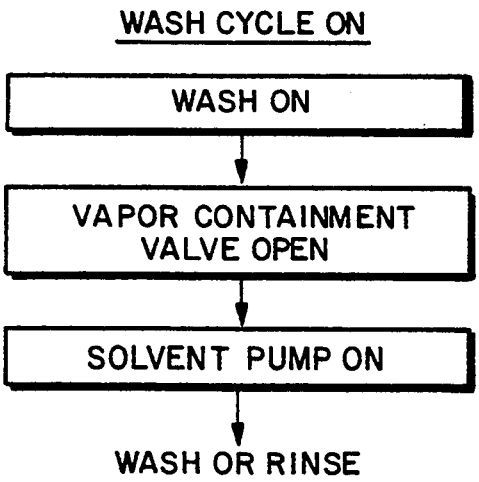
FIG. 15A is a flow diagram illustrating a sequence of operation during the wash cycle.
Figure 15B:
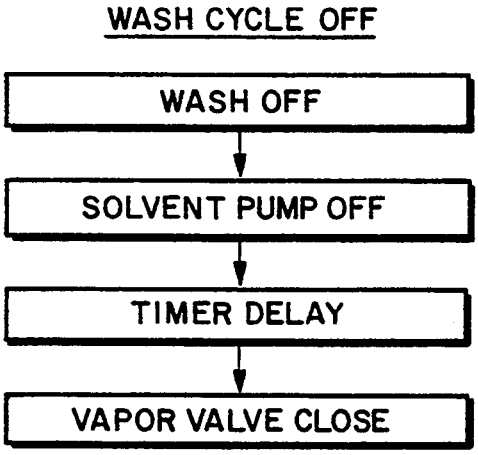
FIG. 15B is a flow diagram illustrating a sequence of deactivation of the wash cycle during intervals of non-use.

After daily parts washing operations, or on such other time intervals as may be desired, the solvent contained within the holding tank 40 (now contaminated after use for washing various articles in the wash basin) is released through a transfer canal 58 into a distillation pot 60 located in a lower portion of the cabinet interior. Referring to FIGS. 9 and 10, at the initiation of a timed solvent recycling process, the vapor containment valve 34 is closed by motor M1 or solenoid which rotates a cam 36, resulting in upward movement of valve stem 37 and causing the valve head 38 to mate against the valve seat 39, and thus preventing the vapors from escaping to atmosphere. Simultaneously, motor M2 or solenoid is activated causing rotation of cam member 64, thereby operating a dual head solvent containment valve assembly 66. Upon initiation of the solvent recycling process (as shown in the flow diagrams of FIGS. 13 and 14), partial rotation of cam member 64 forces a first inner valve stem 70 downwardly to release a lower solvent containment valve head 72 from engagement with a two-way valve seat 76. Simultaneously, partial movement of cam member 64 forces a lever 80 attached to an outer second valve stem 82 outwardly causing the second outer valve stem 82 to be lifted upwardly, resulting in an upper solvent containment valve head 84 being removed from the two way valve seat 76. Upon opening of the solvent containment valve assembly 66, by simultaneous movement of the upper 84 and lower 72 valve heads away from the two-way valve seat 76, the contaminated solvent is released from the holding tank 40 through the transfer canal 58 leading to the distillation pot 60. The bottom 41 of the solvent holding tank 40 is specifically configured to slope toward the solvent containment valve assembly 66, as seen in FIG. 8, so that upon opening of the containment valve assembly, the solvent will readily flow through the transfer canal 58, flushing any accumulated bottom sediment in the holding tank through the transfer canal and into the distillation pot 60. In this manner, accumulation of sediment from the bottom 41 of the holding tank and around the two way valve seat 76 is discouraged.

The distillation pot 60 includes a double wall structure around the sides and bottom including an inner wall 90 and bottom 92 and outer wall 94 and bottom 96 having insulation 98 disposed therebetween, as best seen in FIGS. 3 and 4. A removable lid 100 is suspended within the cabinet by brackets 102 welded to the inner surface of opposite side walls 18, 18' and the top of the lid 100. To facilitate removal and attachment of the lid 100 in sealed engagement over an open top of the distillation pot, a removal assembly 104 is provided including a wheel 106 having a plurality of arms 107 extending therefrom and a vertically oriented threaded stem 108 which threadably engages within a threaded, hollow, concentric bore 110 extending at least partially through a central vertical post 112 of the distillation pot 60. The wheel 106 remains supported upon a platform 114 on the top of the lid 100 with the threaded stem 108 extending downwardly therethrough for threaded engagement within the threaded bore 110 of the central post 112 of the distillation pot 60. Upon rotation of the wheel 106 in a particular direction, by grasping the arms 107 and pulling, the threaded stem 108 may be caused to threadably advance within the hollow bore 110 of the central post 112, resulting in the distillation pot 60 being raised towards the lid 100 until a top edge 120 of the side wall of the pot 60 mates with an under side 122 of the lid. Alternatively, rotation of the wheel in an opposite direction results in lowering of the distillation pot 60, effectively removing the lid. A seal ring 124 may be fitted within a groove formed in an upper edge 120 of the side wall structure of the distillation pot for mating, sealing engagement with the underside surface 122 of the lid 100, thus providing an air tight, sealed connection.

In order to initiate threaded engagement of the stem 108 within the hollow bore 110 of the central post 112 upon attaching the lid to the distillation pot, a cam lever assembly 130 is provided including a shaft 132 having a first end 134 with a knob 135 attached and an opposite end 136 fitted to a cam member 138 which is pivotally attached to a support bracket 140 above the wheel 106. Upon inward movement of the shaft 132 by pressing inwardly on the knob 135, the cam member 138 is caused to rotate such that one end of the cam member 138 forces the wheel 106 and threaded stem 108 downwardly into threaded engagement with the threaded bore 110 of the central post. In order to facilitate upward movement of the wheel 106 and threaded stem 108 when removing the lid, biasing means are provided between the support platform and wheel (not shown for purposes of clarity). To remove the lid, the knob 134 and attached shaft 132 are pulled outwardly, causing the cam 138 to rotate out of engagement with the wheel. Upon disengagement of the threaded stem 108 from within the central post, the biasing means urges the wheel 106 and stem 108 upwardly to clear the central post 112 and upper edge 120 of the side walls of the distillation pot 60.

A plurality of heating elements 150 are provided in the distillation pot 60, including preferably four heating elements attached to the underside of inner bottom 92 of the distillation pot and a fifth heating element 150' disposed within the central post. The heating elements 150, 150' are activated during the recycling process in order to boil the solvent to produce vapors.

A condenser tube 160 includes a first end 162 attached through the lid 100 in fluid communication with an interior of the distillation pot 60 and an opposite end 164 connecting to the solvent holding tank. A mid-section of the condenser tube passes through a cooling zone and defines a condenser 166. The cooling zone is cooled by air flow created by a blower 170. Air is drawn through the cooling zone within which the condenser (mid-section of the condenser tube) is located, and forced out of the rear of the cabinet. A vacuum pump 180 within the cabinet interior interconnects to the holding tank 40 for creating a vacuum in the holding tank 40 and distillation pot 60 via the interconnecting condenser tube 160.

In accordance with the above description, the solvent recycling process is shown in the flow chart in the drawings. Activation of the distillation process is set on a programmable timer provided with a 24 hour, seven day clock. Thus, when the timer reaches the programmed activation time, the recycling process is initiated whereupon motor M2 is activated to partially rotate the cam member 64 resulting in the solvent containment valve assembly 66 being opened. A delay timer keeps the solvent containment valve assembly opened for a sufficient time to allow the solvent in the holding tank 40 to be transferred to the distillation pot 60. After the delay, the solvent containment valves 72, 84 are closed. After a second delay, the vacuum pump 180 is activated to create a vacuum within the holding tank and distillation pot. A vacuum sensor determines whether there is a fault in the system and if so, the entire system is shut down and a remainder of the recycling process is prevented until the fault is corrected. If a sufficient vacuum is sensed, the heating elements 150, 150' are turned on to heat the solvent in the distillation pot. Upon reaching a predetermined temperature, the heating element in the central post of the distillation pot is turned off. Thereafter, the blower 170 is activated and vapor begins to form in the distillation pot and rise through the condenser tube 160, whereupon the vapor is condensed to a liquid state, yielding purified solvent. The purified solvent is lead into the holding tank 40 where it accumulates throughout the recycling process. A vapor temperature sensor in the distillation pot determines when the solvent has been substantially vaporized, at which point, the vacuum pump 18, heating elements 150, 150' and sensors are turned off. At this stage, the holding tank 40 is substantially filled with fresh, purified solvent for use during the next wash cycle.

After several distillation cycles, the distillation pot will accumulate a concentrated amount of contaminate. To facilitate removal of this contaminate and cleaning of the distillation pot, the front door 22 of the cabinet 12 is opened and the lid 100 removed from the distillation pot 60, whereupon the pot can be rolled out from within the cabinet permitting unobstructed access thereto.

Now that the invention has been described,

What is claimed is:

1. An apparatus for washing articles with a solvent comprising:

a cabinet including an upper portion defining a wash basin and a lower portion including a base and side walls disposed in surrounding relation to a cabinet interior, said wash basin including at least a partially surrounding wall structure defining a splash guard, and a floor having a drain means therein to drain the solvent from within said wash basin, a holding tank within said cabinet interior structured and disposed to contain a predetermined charge of the solvent therein, return means interconnecting between said drain means and said holding tank for directing the solvent from said drain means into said holding tank, a spout for discharging the solvent into said wash basin, a pump structured and disposed to circulate the solvent from said holding tank to said spout for discharge into said wash basin, a distillation pot disposed within said cabinet interior and including an insulated side wall structure and bottom and a removable insulated lid structured for sealed, air tight engagement with said side wall structure in covering relation to an open top of said distillation pot, a transfer canal connecting between said holding tank and said distillation pot for selectively transferring contaminated solvent from said holding tank to said distillation pot, solvent containment valve means selectively operable between an open position to release the contaminated solvent into said distillation pot and a closed position preventing the solvent from entering said distillation pot, a vacuum pump interconnected to said holding tank and structured and disposed to create a vacuum within said holding tank and said distillation pot, heating means within said distillation pot structured and disposed for boiling the contaminated solvent contained therein so as to produce a solvent vapor, a condenser including a condensing tube having a first end connected to said distillation pot for receiving the solvent vapor therein, a mid-portion disposed in a cooling zone within said cabinet interior and a second opposite end connecting with said holding tank for directing purified, condensed liquid solvent into said holding tank, and a blower disposed within said cooling zone for directing an air current therethrough to cool said mid-portion of said condensing tube, and thereby causing the solvent vapor to condense to a liquid state so as to produce the purified, solvent.

2. An apparatus for washing articles with a solvent comprising:

a wash basin including a floor with drain means therein structured and disposed for draining the solvent from within said wash basin, a holding tank for containing the solvent, solvent discharge means for circulating and discharging solvent from said holding tank into said wash basin, return means for directing the solvent from said drain means to said holding tank, a distillation pot including a surrounding, insulated side wall structure and bottom, and a removable insulated top lid, transfer means for selectively transferring contaminated solvent from said holding tank to said distillation pot, a vacuum pump connected to said holding tank for creating a vacuum in said holding tank and said distillation pot, heating elements in said distillation pot structured and disposed for boiling the contaminated solvent contained therein to produce solvent vapors, and a condenser structured and disposed to receive and subsequently condense the solvent vapors to yield pure, non-contaminated solvent, said condenser being further structured and disposed to dispense the condensed pure solvent into said holding tank for subsequent circulation and discharge into said wash basin to facilitate washing and rinsing of the articles therein.

3. An apparatus as recited in claim 2 wherein said floor of said wash basin is sloped from opposite sides, a front and a rear of said wash basin downwardly towards a central zone.

4. An apparatus as recited in claim 3 wherein said drain means includes a drain plate fitted to said floor at said central zone, wherein the solvent discharged into said wash basin is directed to said drain plate for passage through said drain means into said holding tank.

5. An apparatus as recited in claim 2 wherein said return means includes a canal interconnecting between said drain means and said holding tank.

6. An apparatus as recited in claim 5 wherein said drain means includes filter means structured and disposed for passage of the solvent therethrough for removing sediment and particulate from the solvent prior to entering said holding tank.

7. An apparatus as recited in claim 5 wherein said return means further includes a vapor containment valve assembly structured and disposed to be operable between an open position, permitting the solvent to flow through said canal to said holding tank, and a closed position, preventing flow of solvent from said wash basin to said holding tank and further preventing solvent fumes and vapors from escaping from said holding tank to atmosphere.

8. An apparatus as recited in claim 2 wherein said solvent discharge means includes a pump within said holding tank and a conduit connecting between said pump and a discharge spout, said discharge spout being structured and disposed for discharging solvent pumped from said holding tank into said wash basin.

9. An apparatus as recited in claim 2 further including a solvent containment valve assembly adjacent said transfer means and selectively operable between a closed position to contain the solvent within said holding tank and an open position to release the solvent from said holding tank for passage through said transfer means and into said distillation pot.

10. An apparatus as recited in claim 9 wherein said solvent containment valve assembly includes a dual valve structure including a first valve head and stem and a second valve head and stem movable in opposing relation to one another for mating engagement and disengagement with a two-sided valve seat.

11. An apparatus as recited in claim 2 wherein said distillation pot includes means for moving said side wall structure and bottom relative to said lid for selectively separating and attaching said lid in sealed, covering relation to an open top of said distillation pot.

* * * * *